US010306957B2

(12) United States Patent
Scandolaro

(10) Patent No.: US 10,306,957 B2
(45) Date of Patent: Jun. 4, 2019

(54) EXTENSIBLE JEWELRY ITEM

(71) Applicant: Picchiotti S.r.l., Valenza AL (IT)

(72) Inventor: Ennio Scandolaro, Valenza (IT)

(73) Assignee: Picchiotti S.r.l., Valenza Al (IT)

( * ) Notice: Subject to any disclaimer, the term of this patent is extended or adjusted under 35 U.S.C. 154(b) by 0 days.

(21) Appl. No.: 15/202,868

(22) Filed: Jul. 6, 2016

(65) Prior Publication Data

US 2018/0008018 A1 Jan. 11, 2018

(51) Int. Cl.

| | |
|---|---|
| ***A44C 5/04*** | (2006.01) |
| ***A44C 5/02*** | (2006.01) |
| ***A44C 9/02*** | (2006.01) |
| ***A44C 5/00*** | (2006.01) |
| ***A44C 17/02*** | (2006.01) |

(52) U.S. Cl.

CPC ..... *A44C 9/02* (2013.01); *A44C 5/0069* (2013.01); *A44C 5/0084* (2013.01); *A44C 5/025* (2013.01); *A44C 17/02* (2013.01); *A44C 5/022* (2013.01); *A44C 5/04* (2013.01)

(58) Field of Classification Search

CPC ... A44C 17/02; A44C 17/0241; A44C 17/025; A44C 17/0283; A44C 5/08; A44C 5/0069; A44C 5/0076; A44C 5/02; A44C 5/022; A44C 5/04; A44C 9/02; A44C 5/0053; A44C 5/0061

See application file for complete search history.

(56) References Cited

U.S. PATENT DOCUMENTS

| | | | | | |
|---|---|---|---|---|---|
| 687,217 | A * | 11/1901 | Fritschle | A44C 5/08 | 132/75.4 |
| 1,099,810 | A * | 6/1914 | Mehrlust | A44C 5/08 | 59/79.3 |
| 1,515,499 | A * | 11/1924 | Lederer | A44C 5/0076 | 59/2 |
| 1,550,024 | A * | 8/1925 | Garst | A44C 5/08 | 59/79.2 |
| 1,621,205 | A * | 3/1927 | Jones et al. | A44C 5/08 | 198/850 |
| 1,660,438 | A * | 2/1928 | Fielding | A44C 5/08 | 59/79.2 |
| 2,302,426 | A * | 11/1942 | Domler | A44C 5/08 | 59/79.2 |
| 2,433,657 | A * | 12/1947 | Flaig | A44C 5/08 | 224/175 |
| 2,510,774 | A * | 6/1950 | Engel | A44C 5/105 | 63/26 |
| 2,608,050 | A * | 8/1952 | Bender | A44C 5/08 | 59/79.2 |

(Continued)

*Primary Examiner* — Emily M Morgan

(74) *Attorney, Agent, or Firm* — Adam K. Sacharoff; Much Shelist, P.C.

(57) ABSTRACT

A jewelry item is provided to include a ring-shaped spring and a ring-shaped chain. The ring-shaped chain has a plurality of chain links, each of which is slidably attached to the ring-shaped spring. Each chain link has a plate with a first surface facing the spring and a second surface opposite to the first surface. Each chain link further has a seat and a hook opposite to each other. The hook is inserted into a seat of a subsequent chain link so as to lock the chain links to each other while allowing the chain links to reversibly slide from a compressed position to an expanded position with respect to each other.

7 Claims, 6 Drawing Sheets

(56) References Cited

U.S. PATENT DOCUMENTS

| | | | | |
|---|---|---|---|---|
| 2,667,739 | A * | 2/1954 | Flaig | A44C 5/08 59/79.2 |
| 2,753,682 | A * | 7/1956 | Gerstenblith | A44C 5/08 59/79.2 |
| 7,607,320 | B2 * | 10/2009 | Perle | A44C 13/00 59/85 |
| 2007/0056321 | A1 * | 3/2007 | Sowle | A44C 9/00 63/40 |

* cited by examiner

EXTENSIBLE JEWELRY ITEM

BACKGROUND OF THE INVENTION

The present disclosure relates to a jewelry item. Such jewelry item can be for example a ring adapted to be word on a finger of a user, a bracelet or any other kind of chain-like item. Such jewelry items are usually decorated with cut stones or gems for aesthetic reasons.

As it is known in the field of jewelry, the jewelry item has to adapt to the size of the body part of the owner, for example a finger in case of a ring. Historically, adapting the jewelry item was a complex and lengthy operation, often requiring the work of a skilled jeweler or goldsmith. In order to partially overcome this drawback, it has been known for some time to craft jewelry items as chains comprising a plurality of links. These links have each a first and second edge, and the first edge of each link is designed to couple with the second edge of the next link. Usually, the first and second edge are secured by a pin or similar device, so that they can rotate with respect to each other.

The kind of known jewelry items described above can be lengthened or shortened by adding or removing links. A disadvantage of such jewelry items is that, while they usually do not need a skilled goldsmith to change size, they still have a somewhat complex structure. This complicates assembly, disassembly as well as replacement, addition or removal of links.

Additionally such jewelry item, particularly in case of rings, cannot be adapted to small changes in size because, while each link is relatively small, its addition or removal still produce a big change in size.

SUMMARY OF THE INVENTION

A first embodiment of the invention relates to a jewelry item. The jewelry item comprises an elastic ring-shaped support element. The jewelry item also comprises a ring-shaped chain comprising a plurality of chain links. Each chain link is slidably attached to the support element. Also, each chain link comprises a female portion and a male portion opposite to each other. The male portion is inserted into a female portion of a subsequent chain link in order to lock the chain links to each other while allowing the chain links to reversibly slide from a contact position to a distanced position with respect to each other.

A second embodiment also relates to a jewelry item. Such jewelry item comprises a ring shaped spring. The jewelry item also comprises a ring-shaped chain comprising a plurality of chain links.

Each chain link is slidably attached to the support element. Also, each chain link comprises a plate having a first surface facing the spring and a second surface opposite to the first surface.

Each chain link also comprises at least a seat and a hook opposite to each other. The hook is inserted into a seat of a subsequent chain link so as to lock the chain links to each other while allowing the chain links to reversibly slide from a contact position to a distanced position with respect to each other.

BRIEF DESCRIPTION OF THE DRAWINGS

Further details and specific embodiments will refer to the attached drawings, in which.

DETAILED DESCRIPTION

The following description of exemplary embodiments refer to the accompanying drawings. The same reference numbers in different drawings identify the same or similar elements. The following detailed description does not limit the invention. Instead, the scope of the invention is defined by the appended claims. Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

With reference to the attached drawings, with 1 is indicated a jewelry item according to an embodiment of the present invention. Such jewelry item 1 may be a ring adapted to be wornon a finger of a user. Alternatively, the jewelry item 1 can be a bracelet, an anklet or any other body-fitting chain-like jewel.

Figure 1:
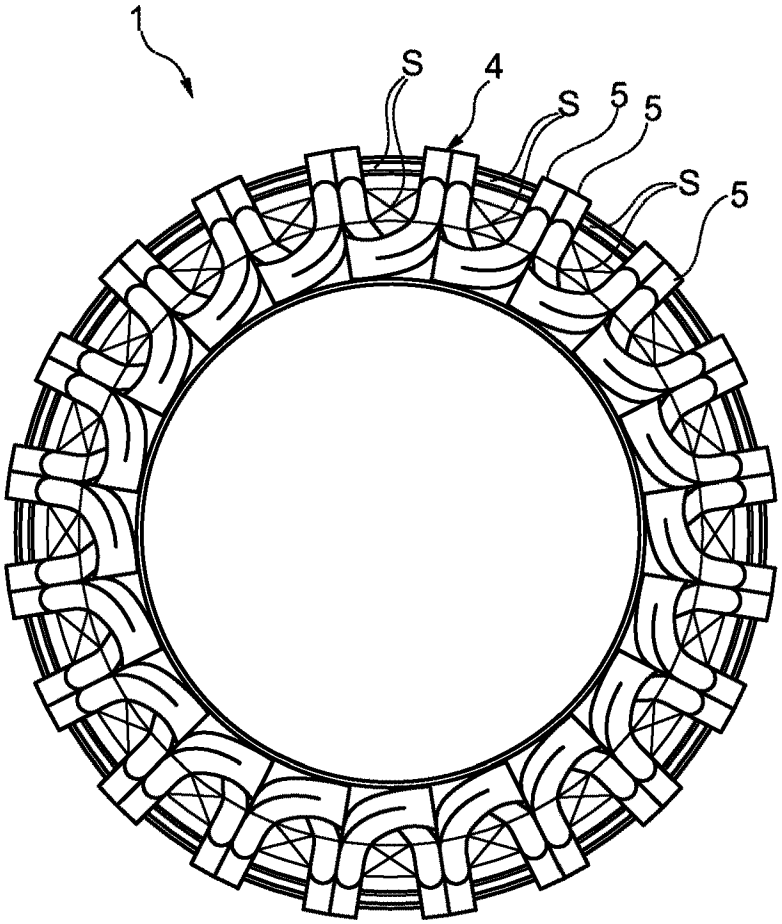
FIG. 1 is a side view of a jewelry item according to a first embodiment of the invention.
Figure 2:
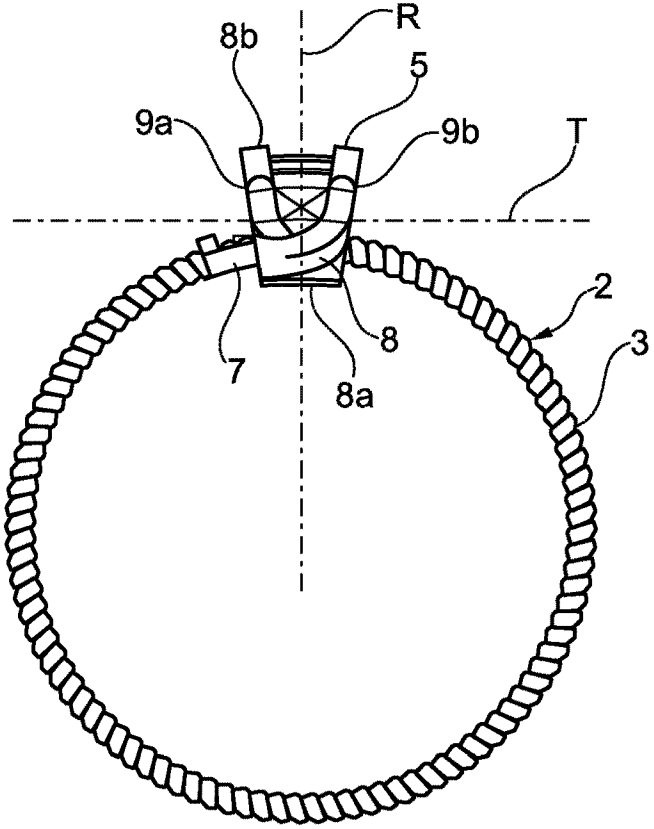
FIG. 2 is a side view the jewelry item of FIG. 1 with some elements removed to better show others.
Figure 3:
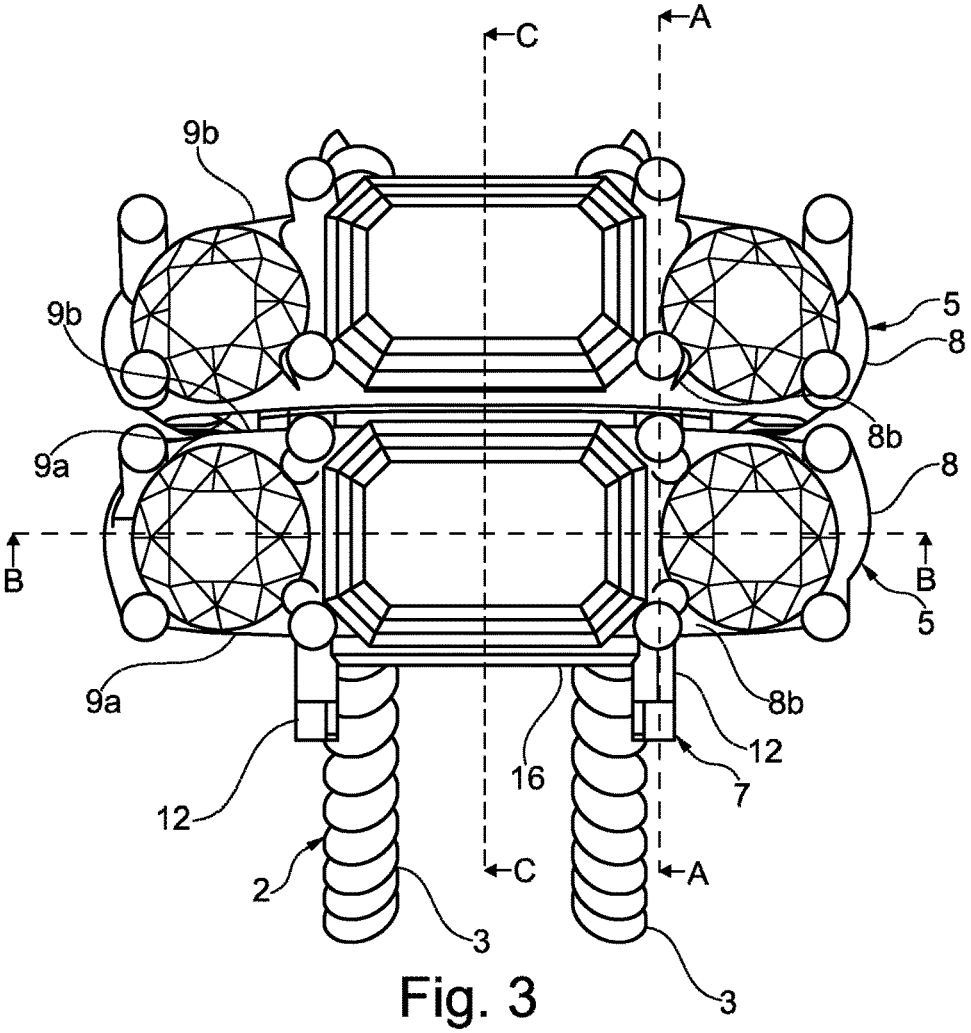
FIG. 3 is a top view of the jewelry item of FIGS. 1 and 2 with some elements removed to better show others.
Figure 9:
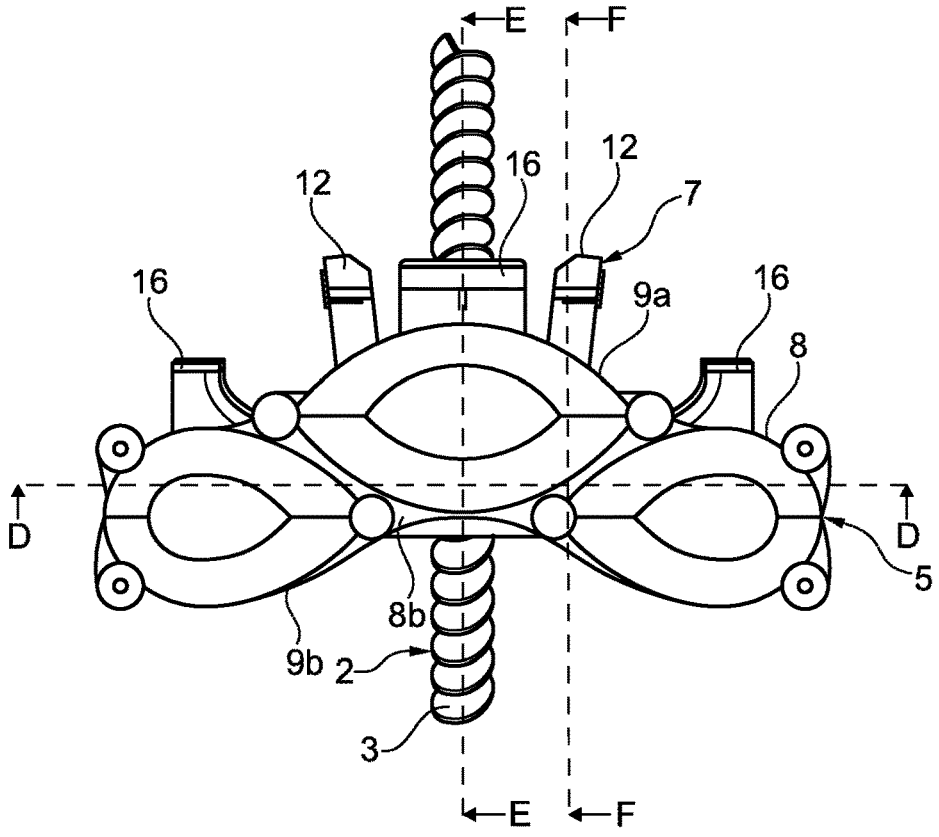
FIG. 9 is a top view of the jewelry item of FIGS. 7 and 8 with some elements removed to better show others.

The jewelry item 1 comprises an elastic ring-shaped support element 2. Advantageously, the support element 2 can comprise one or more spring 3. The spring 3 is preferably a coil spring, and more preferably made of titanium. In the embodiment of FIG. 9, the support element 2 comprises a single spring 3. In the embodiment of FIG. 3, the support element 2 comprises two springs 3.

The jewelry item 1 also comprises a ring-shaped chain 4. The chain 4 is attached to the support element 2, and it is able to slide over the support element 2. Also, the chain 4 is able to change its length, so as to be adaptable to small variations in finger size. Indeed, as the support element 2 is stretched, the chain 4 is able to change follow it by changing its own length.

The chain 4 comprises a plurality of chain links 5. Preferably, the number of links 5 is variable depending on the base size as well as on the particular model of the jewelry item 1. For example, in case of a ring the number of links 5 can be comprised between 5 and 15. Alternatively, in case of a bracelet, the number of links 5 can be comprised between 10 and 20.

With more detail, each link 5 is slidably attached to the support element 2. Therefore, with respect to each link 5 is defined a radial direction "R" and a tangential direction "T" transversal, and preferably perpendicular, to the radial direction "R".

The links 5 are attached to each other so that they can change the reciprocal distance, in order to allow the chain 4 to change its length. In other words, the length of the chain 4 changes depending on the distance of between the links 5. Also, each link 5 comprises a plate 8 having a first surface 8*a* facing radially outwardly and away from the support element 2 and a second surface 8*b* opposite to the first surface 8*a*, thus facing radially outwardly and away from away from the support element 2. It is understood that the plate 8 can have a slight curvature, as shown for example in FIGS. 5 and 12 or can be flat.

Preferably, the plate 8 is provided with least a bezel 11, or other equivalent stone setting means. The bezel 8 is configured to bear a stone "S", and is in particular placed on the second surface 8*b* of the plate 8 itself in both embodiments shown in the figures each plate 8 comprises three bezels 11, however in other embodiments of the invention there can be any number of bezels 11, depending on their size and on the size of the plate 8 itself.

In its simplest version, the plate 8 can be rectangular. More generally, the plate 8 has a first 9*a* and second edge 9*b*. The first edge 9*a* has an outline complementary to the second edge. Therefore, the first edge 9*a* of a link 5 can be inserted into the second edge of a subsequent link when the chain links are in a contact position. See for example the embodiment in FIG. 9, in which the first edge 9*a* of the plate 8 has a convex profile, while the second edge 9*b* has a matching concave profile.

Furthermore, the first edge 9*a* may be provided with a projection 16 which extends outwardly from the plate 8. In this case, the second edge 9*b* is provided with a receptacle 17 to receive the projection 16 of the adjacent plate 8.

Indeed, the number of projections 16 can vary. For example, in the embodiment shown in FIGS. 3 and 5 there is only one projection 16, which however extends over most of the width of the plate 8. On the other hand, in the embodiment shown in FIGS. 9 and 12 the plate 8 comprises three projections 16, one placed centrally over the spring 3 and the others externally and symmetrically with respect to the spring 3.

Figure 5:
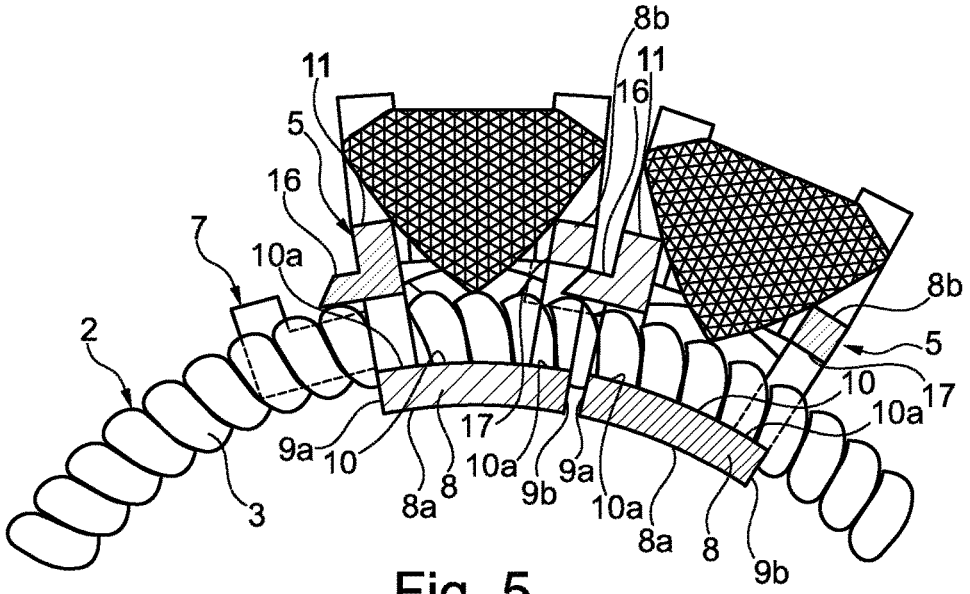
FIG. 5 is a sectional view of a detail of the jewelry item of FIGS. 1-3 along a plane C-C of FIG. 3.
Figure 11:
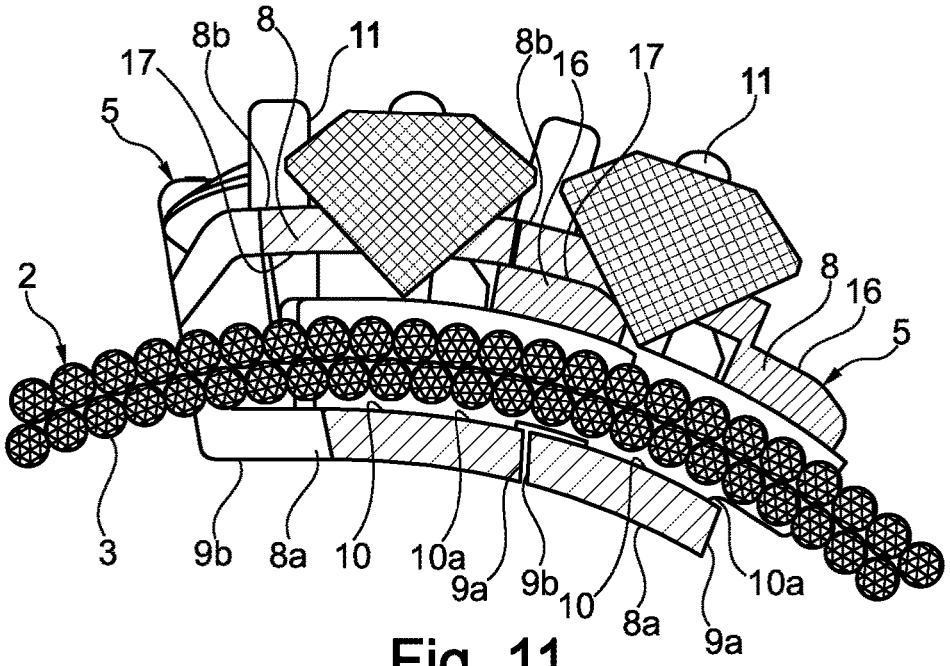
FIG. 11 is a sectional view of a detail of the jewelry item of FIGS. 7-9 along a plane E-E of FIG. 9.

As seen for example in FIGS. 5 and 11, the plate 8 is provided with at least a housing 10 for the spring 3. The housing 10 runs substantially along the tangential direction "T" in order to house a portion of the spring 3, thus securing the plate 8 on the support element 2. The housing 10 is defined by two openings 10*a* on the plate 8, placed in particular ora the edges 9*a*, 9*b*.

Figure 4:
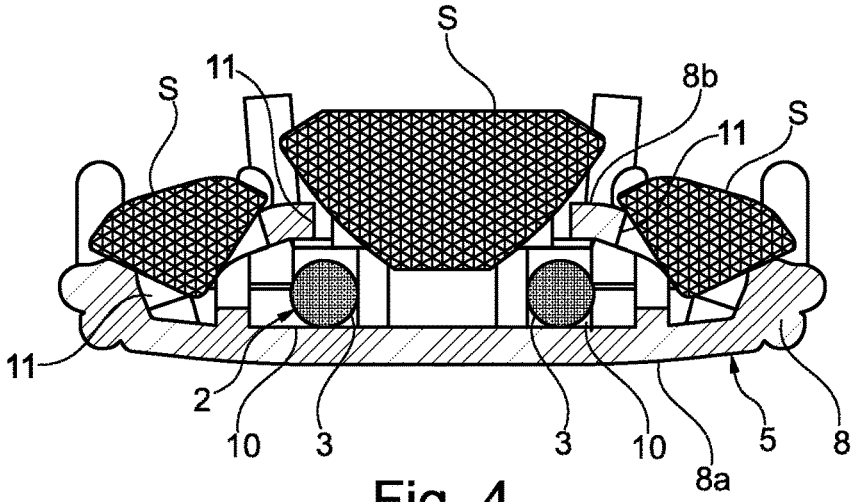
FIG. 4 is a sectional view of a detail of the jewelry item of FIGS. 1-3 along a plane B-B of FIG. 3.
Figure 10:
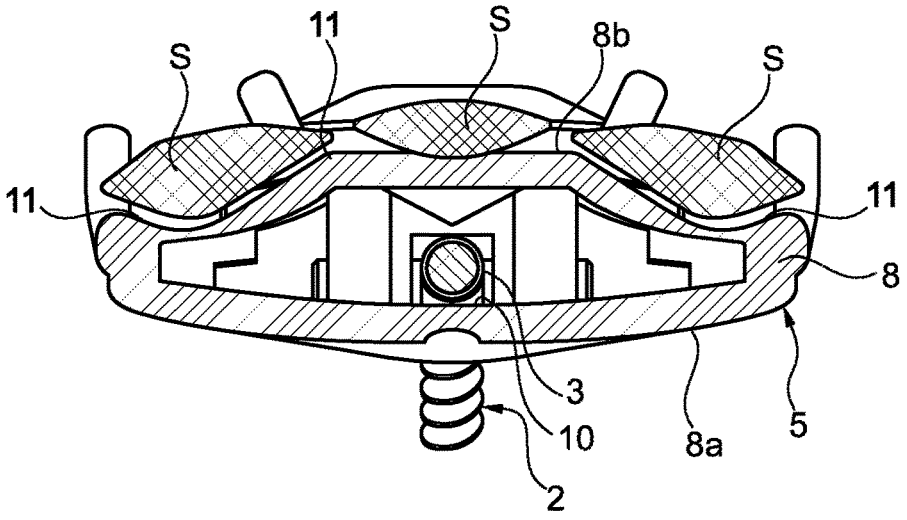
FIG. 10 is a sectional view of a detail of the jewelry item of FIGS. 7-9 along a plane D-D of FIG. 9.

With additional detail, the plate 8 is provided with one housing 10 for each spring 3. Indeed, in the embodiment of FIG. 4, the plate 8 is provided with two housings 10. On the other hand, in the embodiment of FIG. 10 the plate 8 is provided with only one housing 10.

In order to attach the links 5 to each other, each link 5 comprises a female portion 6 and a male portion 7. Therefore, the insertion of the male portion 7 into the female portion 6 of a subsequent link 5 is able to lock the links 5 to each other while also allowing the chain links to reversibly slide from a contact position to a distanced position with respect to each other. Additionally, while locked in this way the links 5 maintain the capability to rotate with respect to each other of a certain amount, so that it is possible to change the curvature of the chain 4.

Please note that, in the disclosed embodiments, the male portion 7 comprises at least a hook 12 and the female portion 6 comprises at least a seat 13. The hook 12 is adapted to be inserted into the seat 13. Preferably, as shown in FIGS. 3 and 9 respectively, in the two described embodiments of the invention the male portion comprises two hooks 12 and two seats 13. It is to be noted that each hook 12 is placed at the same distance from the spring 3 as the corresponding seat 13, so that all of the hooks 12 can be inserted in the corresponding seats 13 when the springs 3 are inserted into the housings 10 of the plates 8.

Figure 6:
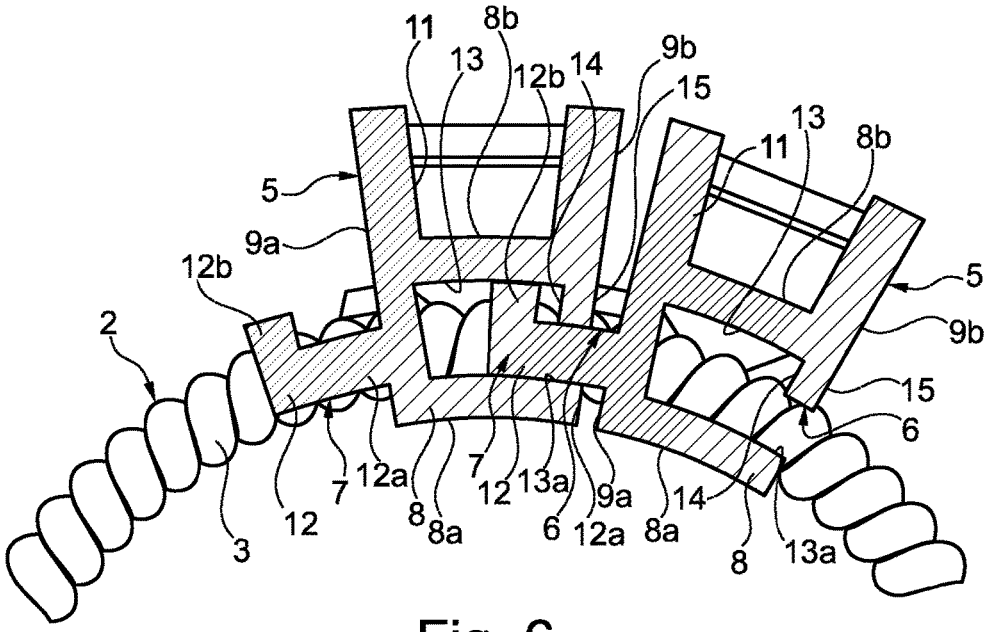
FIG. 6 is a sectional view of a detail of the jewelry item of FIGS. 1-3 along a plane A-A of FIG. 3.
Figure 8:
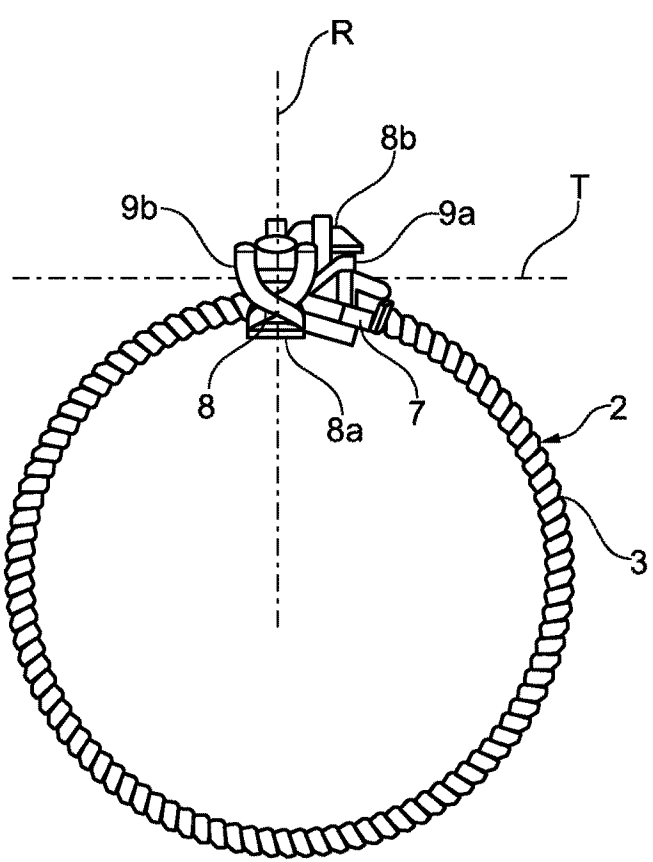
FIG. 8 is a side view the jewelry item of FIG. 7 with some elements removed to better show others.
Figure 7:
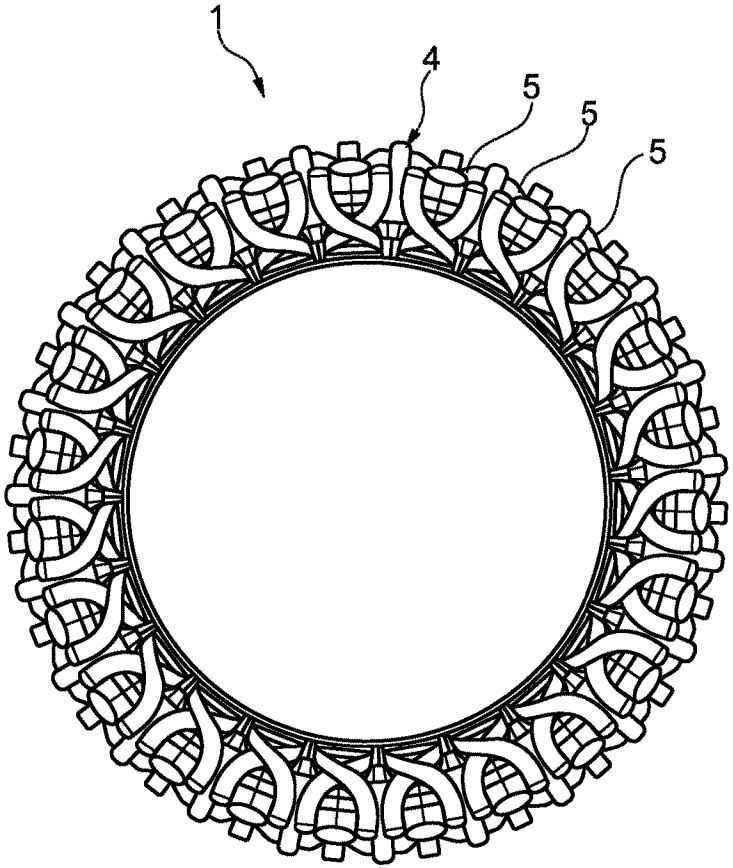
FIG. 7 is a side view of a jewelry item according to a second embodiment of the invention.
Figure 12:
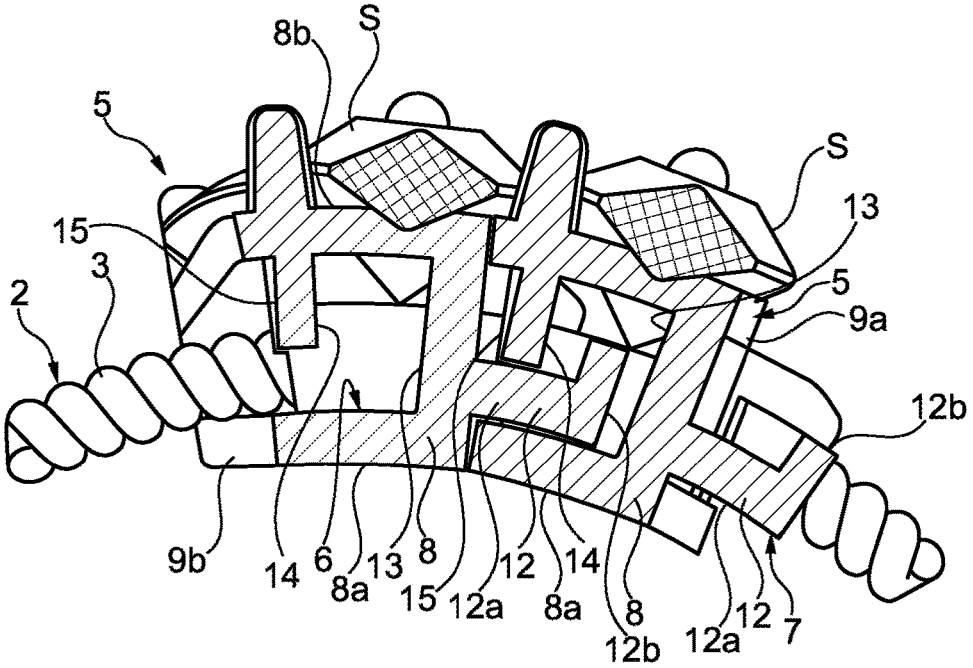
FIG. 12 is a sectional view of a detail of the jewelry item of FIGS. 7-9 along a plane F-F of FIG. 9.

As shown schematically in the sections of FIGS. 6 and 12, the hook 12 is attached to the first edge 9*a* of the plate 8. The hook 12 comprises a first portion 12*a*, fixed onto the plate 8 and extending substantially along the tangential direction "T". A second portion 12*b*, itself fixed to the first portion 12*a*, projects at least in part along the radial direction "R" away from a center of the jewelry item 1. Furthermore, the seat 13 is provided with an opening 13*a* for the insertion of the hook 12. Specifically, the opening 13*a* allows the insertion of the second portion 12*b* of the hook 12, and partial insertion of the first portion 12*a*. The opening 13*a* is sized so that it is larger than the thickness of both the first 12*a* and the second portion 12*b* of the hook 12, but it is narrower than the height of the second portion 12*b*. Consequently, the second portion 12*b* can be inserted and/or extracted from the seat 13 by placing the hook 12 and the seat 13 at appropriate inclination. However, once the hook 12 is oriented so that the second portion 12*b* is aligned with the radial direction "R", it cannot be extracted from the seat 13.

As best shown in FIGS. 6 and 12, the seat is provided internally with a first abutting surface 14, and externally with a second abutting surface 15. The first portion 12*a* of the hook 12 is sized so that the hook 12 can move inside the seat 13 in order to allow the links 5 to move from the contact position to the distanced position, as discussed above. Indeed, when the links 5 are in the contact position the first 9*a* and the second edge 9*b* of the plates 8 are in contact with each other, specifically a portion of the first edge 9*a* of each plate 8 rests on the second abutting surface 15. Otherwise, when the links 5 are in the distanced position the hook 12, in particular its second portion 12*b* rests against the first abutting surface 14. In any possible intermediate position neither the hooks 12 nor the first edges 9*a* are in contact with the respective abutting surface 14, 15.

The invention claimed is:

1. Jewelry item, comprising:

a ring-shaped spring;

a ring-shaped chain comprising a plurality of chain links; and each chain link being made as a single piece and being slidably attached to the ring-shaped spring, each chain link defining a tangential direction substantially tangential to the ring-shaped spring and a radial direction perpendicular to the tangential direction, each chain link comprising:

an upwardly facing external surface positioned outwardly along the tangential direction, the upwardly facing external surface including at least one bezel configured to bear a stone, a first external side surface and a second external side surface extending in the radial direction and configured to face subsequent chain links such that the first external side surface faces the second external side surface of the subsequent chain link;

the first external side surface having at least a projection extending outwardly in the tangential direction and the second external side surface having at least a receptacle configured to receive the projection of the subsequent chain link when subsequent chain links are abutting each other;

a pair of hooks extending on either side of the projection made as a single piece and integral with the first external side surface, each hook also having a first portion fixed onto the main body and extending at least in part along the tangential direction, a second portion fixed to the first portion and projecting at least in part along the radial direction away from a center of the ring-shaped chain;

a pair of seats inside the chain link and opposite to the pair of hooks, the pair of seats each having an internal abutting surface made as a single piece and integral with the main body, the pair of seats also having an opening; and wherein the each hook is inserted into a corresponding seat of a subsequent chain link, the first portion of the hook being sized to allow the hook to slide inside the seat to reversibly switch the ring-shaped chain from a compressed position to an expanded position, the second portion of the hook of each chain link being in contact with the internal abutting surface of the seat of the subsequent chain link when the ring-shaped chain is in the expanded position, and wherein the first external side surface has a shape which is complementary to a shape of the second external side surface such that a substantial portion of the first and second external side surfaces abut when in the compressed position.

2. The jewelry item of claim 1, wherein the ring-shaped spring is made of titanium.

3. The jewelry item of claim 1, wherein the ring-shaped chain in the compressed position has a circumference sized to allow the ring-shaped chain to be worn around a finger without slipping.

4. The jewelry item of claim 1, wherein the ring-shaped chain in the compressed position has a circumference sized to allow the ring-shaped chain to be worn around a wrist without slipping.

5. The jewelry item of claim 1, wherein the first external side surface has a convex shape, the second external side surface having a matching concave shape.

6. The jewelry item of claim 1, wherein the opening of the seat is sized to allow the insertion of the second portion of the hook, the seat being also sized to allow the partial insertion of the first portion of the hook.

7. The jewelry item of claim 1 wherein the opening of the seat is sized so that it is larger than a thickness of both the first and the second portion of the hook, the opening being narrower than a length of the second portion in the radial direction.

* * * * *